US010648189B2

(12) United States Patent
DeSantis

(10) Patent No.: US 10,648,189 B2
(45) Date of Patent: May 12, 2020

(54) PORTABLE SWIM LANE

(71) Applicant: Ryan DeSantis, Tustin, CA (US)

(72) Inventor: Ryan DeSantis, Tustin, CA (US)

( * ) Notice: Subject to any disclaimer, the term of this patent is extended or adjusted under 35 U.S.C. 154(b) by 0 days.

(21) Appl. No.: 16/123,813

(22) Filed: Sep. 6, 2018

(65) Prior Publication Data

US 2020/0080330 A1 Mar. 12, 2020

(51) Int. Cl.
*E04H 4/14* (2006.01)

(52) U.S. Cl.
CPC ..... *E04H 4/145* (2013.01); *E04H 4/143* (2013.01)

(58) Field of Classification Search
CPC ..... E04H 4/145; E04H 4/143
USPC ..... 4/505
See application file for complete search history.

(56) References Cited

U.S. PATENT DOCUMENTS 3,460,166 A * 8/1969 Weber ..... E04H 4/129 4/493
3,582,999 A * 6/1971 Baker ..... E04H 4/145 4/505
2007/0154319 A1* 7/2007 Stiles, Jr. ..... F04B 49/20 417/42
2010/0095448 A1* 4/2010 Goldmann ..... E04H 4/129 4/505

OTHER PUBLICATIONS

Website https://www.endlesspools.com/, Endless Pools Swimming Machines, 9 pages, Aug. 29, 2018.
Website https://leisurepoolsusa.com/equipment/swim-jet-systems, Swim Jet Systems, 3 pages, Aug. 29, 2019.

* cited by examiner

*Primary Examiner* — Huyen D Le

(57) ABSTRACT

A swim lane apparatus having one or more attachment or tethering devices. The one or more attachment or tethering devices are configured to couple or affix to a foundation of the pool. The swim lane apparatus has a first sidewall. The first sidewall is coupled to the one or more attachment or tethering devices. The first sidewall is configured to form a channel and direct a flow of water out of the channel when the flow of water enters the channel.

18 Claims, 9 Drawing Sheets

PORTABLE SWIM LANE

BACKGROUND

1. Field

The present invention relates to a portable and/or modular swim lane or enclosure.

2. Description of the Related Art

Swimmers often enjoy swimming laps in a pool for exercise. However, swimmers do not always have ready access to a lap pool or other large pool to conveniently swim laps. For example, in a typical pool installed at a person's home, the pool may be of sufficient length for a swimmer to make only a few strokes before having to change directions. Thus, a swimmer may have to travel to a fitness center or other community pool to have access to a large pool that allows the swimmer to conveniently swim laps across a length of a pool without having to stop, turn or otherwise change directions.

Swimmers may install swim jets in the pool to allow a swimmer to swim in place. The swim jets blow, move or push a current or flow of water out the swim jet into the pool. A swimmer swims in front of and opposing the current or flow of water that exits the swim jet. This allows the swimmer to swim in place. Swim jets installed in a pool, however, are inefficient. The current or flow of water that exits the swim jet dissipates or moves in many directions as the water exits, which reduces the opposing force of the current or flow of water.

Alternatively, swimmers may use an endless pool to swim laps. An endless pool is an individual-sized pool with a swim jet. The swim jet ejects a current or flow of water out the swim jet into an enclosure, which allows the swimmer to swim in place against the current or flow of water. Endless pools, however, are limited in size, not portable and are unable to be used within a normal outdoor family or community-sized pool.

Accordingly, there is a need for a portable and/or modular swim apparatus that more efficiently creates a swim lane for a swimmer to swim in place and that may be retro-fitted to a family-sized and/or irregular-sized pool.

SUMMARY

In general one aspect of the subject matter described in this specification is embodied in a swim lane apparatus for a pool. The swim lane apparatus includes one or more attachment or tethering devices. The one or more attachment or tethering devices are configured to couple or affix to a foundation of the pool. The swim lane apparatus includes a first sidewall. The first sidewall is coupled to the one or more attachment or tethering devices. The first sidewall is configured to form a channel and direct a flow of water out of the channel when the flow of water enters the channel.

These and other embodiments may include one or more of the following features. The swim lane apparatus may include a second sidewall. The second sidewall may be coupled to the one or more attachment or tethering devices. The second sidewall may be positioned parallel to the first sidewall. The first sidewall and the second sidewall may form the channel. The channel may have an entrance and an exit. The flow of water may enter the channel at the entrance. The first sidewall and the second sidewall may be configured to direct the flow of water in a longitudinal direction substantially parallel to the channel toward the exit of the channel or in a direction angled inward toward the exit of the channel.

The one or more attachment or tethering devices may be coupled or affixed in proximity to a sidewall of the foundation of the pool. The first sidewall and the sidewall of the foundation of the pool may form the channel and may direct the flow of water out of the channel. The first sidewall may include a first barrier. The first barrier may be configured to direct the flow of water through the channel. The first sidewall may include one or more first support members. The one or more first support members may be connected to the first barrier. The one or more first support members may be configured to provide structural support to hold or position the first barrier.

The swim lane apparatus may include one or more first flotation or buoyancy devices. The one or more first flotation or buoyancy devices may be coupled to the one or more first support members. The one or more first flotation or buoyancy devices may be configured to maintain a portion of the first barrier above the water when the swim lane apparatus is positioned in the water of the pool. The swim lane apparatus may include a second sidewall. The second sidewall may include a second barrier that may direct the flow of water through the channel. The second sidewall may include one or more second support members. The one or more second support members may be connected to the second barrier. The one or more second support members may be configured to provide structural support to hold or position the second barrier. The swim lane apparatus may include one or more second flotation or buoyancy devices that may be coupled to the one or more second support members. The one or more second flotation or buoyancy devices may be configured to maintain a portion of the second barrier above the water when the swim lane apparatus is positioned in the water of the pool The swim lane apparatus may include one or more third support members. The one or more third support members may be coupled to the first sidewall and the second sidewall. The one or more third support members may be in a raised position at an exit of the channel to allow a user to within the channel in between the first sidewall and the second sidewall.

The first sidewall may be partially submerged underwater when positioned within the water of the pool. The first sidewall may be made from a semi-permeable membrane. The one or more attachment or tethering devices may be a rope. The rope may be fastened to the semi-permeable membrane. The one or more attachment or tethering devices may include an anchor. The anchor may be inserted into a cavity within the foundation to fasten or connect the one or more attachment or tethering devices to the foundation.

In another aspect, the subject matter is embodied in a portable swim lane system for a pool. The portable swim lane system may include a swim jet that is configured to pump or move water out. The portable swim lane system may include a swim lane apparatus. The swim lane apparatus is configured to direct a direction or a flow of the water. The swim lane apparatus includes one or more one or more attachment or tethering devices that are configured to couple or affix to a foundation of the pool. The swim lane apparatus includes at least one of a first sidewall or a second sidewall coupled to the one or more attachment or tethering devices and configured to direct a flow of water.

In another aspect, the subject matter is embodied in a swim lane apparatus. The swim lane apparatus includes multiple sidewalls. The multiple sidewalls include a first sidewall and a second sidewall that are configured to form a channel or a swim lane. The first sidewall and the second sidewall remain partially submerged when placed into a pool having water. The swim lane apparatus includes one or more connecting members that connect and space apart the first sidewall and the second sidewall to form the channel or the swim lane.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Disclosed herein are an apparatus, method and/or system for a portable swim lane. Particular embodiments of the subject matter described in this specification may be implemented to realize one or more of the following advantages. The swim lane apparatus may be portable and/or may be able to be retro-fitted to a normal and/or irregular sized pool, which allows a swimmer to conveniently unpack, deploy, transport and/or otherwise use the swim lane in any pool. Thus, the swimmer can conveniently swim laps and exercise within any pool that has a swim jet.

The swim lane apparatus also focuses funnels or directs the current or flow of water that exits a swim jet down a channel or inward within a swim lane. By focusing or directing the current or flow of water, the swim lane apparatus maximizes the opposing force of the current or flow of water. Since the swim lane apparatus maximizes the current, the swim lane apparatus reduces the amount of power that is needed to blow the current or flow of water out the swim jet, which reduces cost and maximizes energy efficiency.

Other benefits and advantages may include the portability and/or modularity of the swim lane apparatus. For example, the swim lane apparatus may be formed from multiple interconnected parts. The multiple interconnected parts allow the width, the length and overall size of the swim lane apparatus to be configurable. Since the overall dimensions are configurable, the swim lane apparatus may adapt to the size of the swimmer and/or may be adapted to control the rate of the current or flow of water that is directed inward down the channel or swim lane.

Moreover, since the swim lane apparatus may be modular and formed from multiple interconnected parts, the swim lane apparatus may be easily assembled and/or disassembled. When the swimmer is done using the swim lane apparatus, the swim lane may also be collapsible to allow for easy storage and/or assembly.

Additionally, the swim lane apparatus may be part of a swim lane system. The swim lane system may include the swim lane apparatus and/or one or more swim jets. The swim lane system may automatically adjust a flow rate of the current of water ejected from the one or more swim jets and the dimensions of the swim lane apparatus to manage the current of water flowing within the swim lane to accommodate a swimmer. Thus, the swim lane system may automatically adjust to increase or decrease the force of the current of water based on the speed of the swimmer or the swimmer's preferences so that the swimmer remains swimming in place within the swim lane.

Figure 1A:
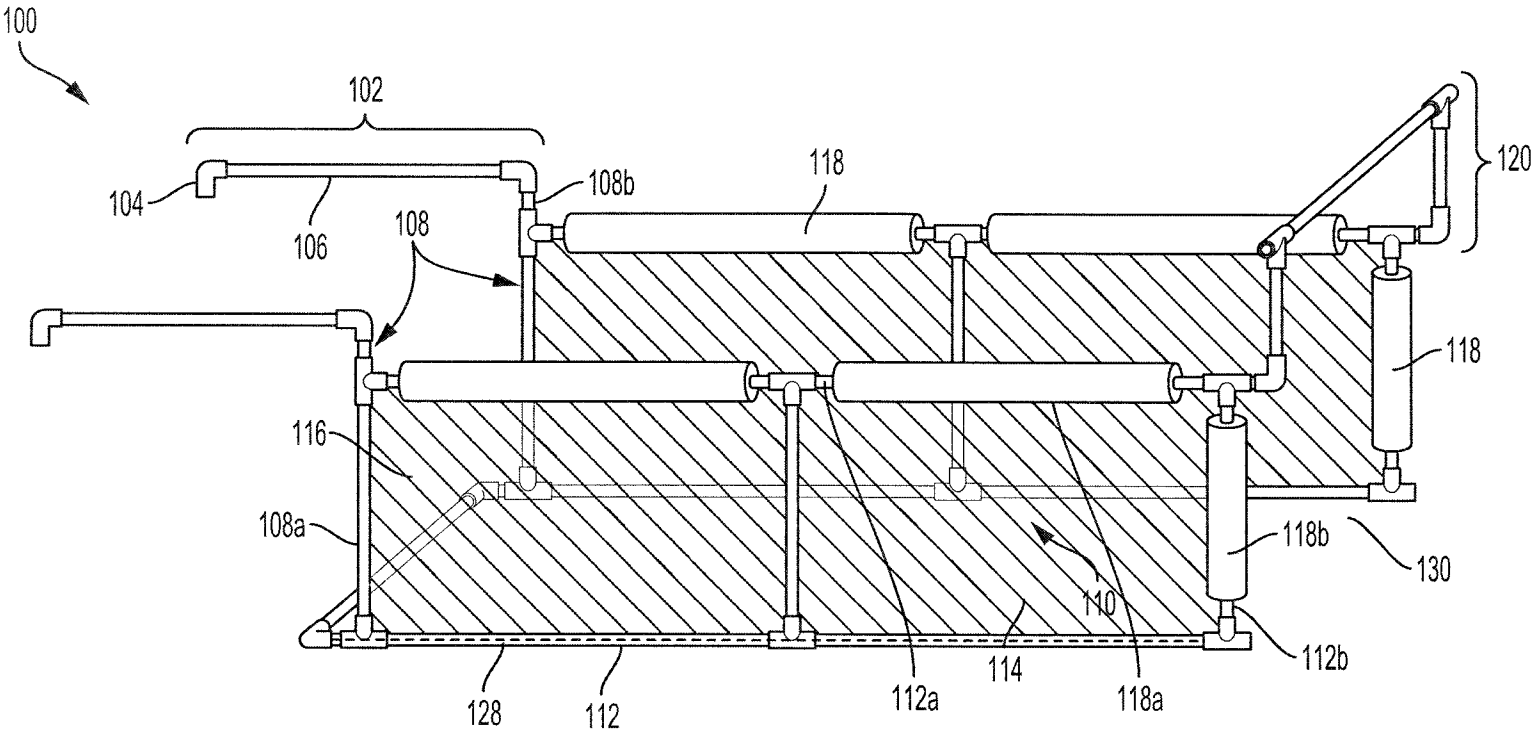
FIG. 1A shows an example swim lane apparatus for a pool according to an aspect of the invention.

FIG. 1A shows a swim lane apparatus 100 for a pool. The swim lane apparatus 100 has one or more attachment or tethering devices 102 and one or more sidewalls 108. The swim lane apparatus 100 may have one or more flotation or buoyancy devices ("flotation devices") 118 and/or a raised portion 120.

Figure 3:
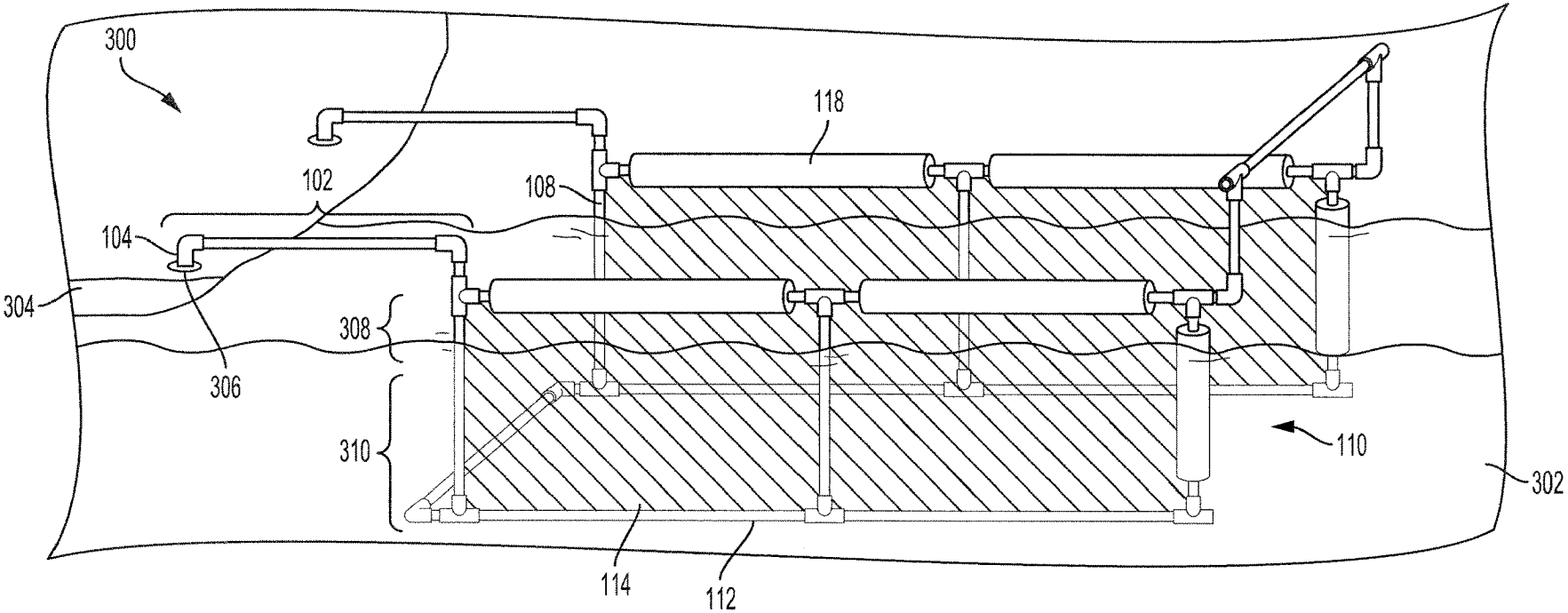
FIG. 3 shows the swim lane apparatus in the pool according to an aspect of the invention.

The one or more sidewalls 108 may be formed from one or more support members 112 and one or more barriers 113. When assembled and placed in the water of the pool, the swim lane apparatus 100 may be partially submerged. That is, a bottom portion of the swim lane apparatus 100 is underneath the surface of the water of the pool and an upper portion of the swim lane apparatus 100 is above the surface of the water of the pool, as shown in FIG. 3 for example. This creates a channel or a swim lane 110 between a sidewall 108 of the swim lane apparatus 100 with a sidewall of the foundation of the pool or another sidewall of the swim lane apparatus 100. A swimmer may swim within the swim lane 110.

Figure 1B:
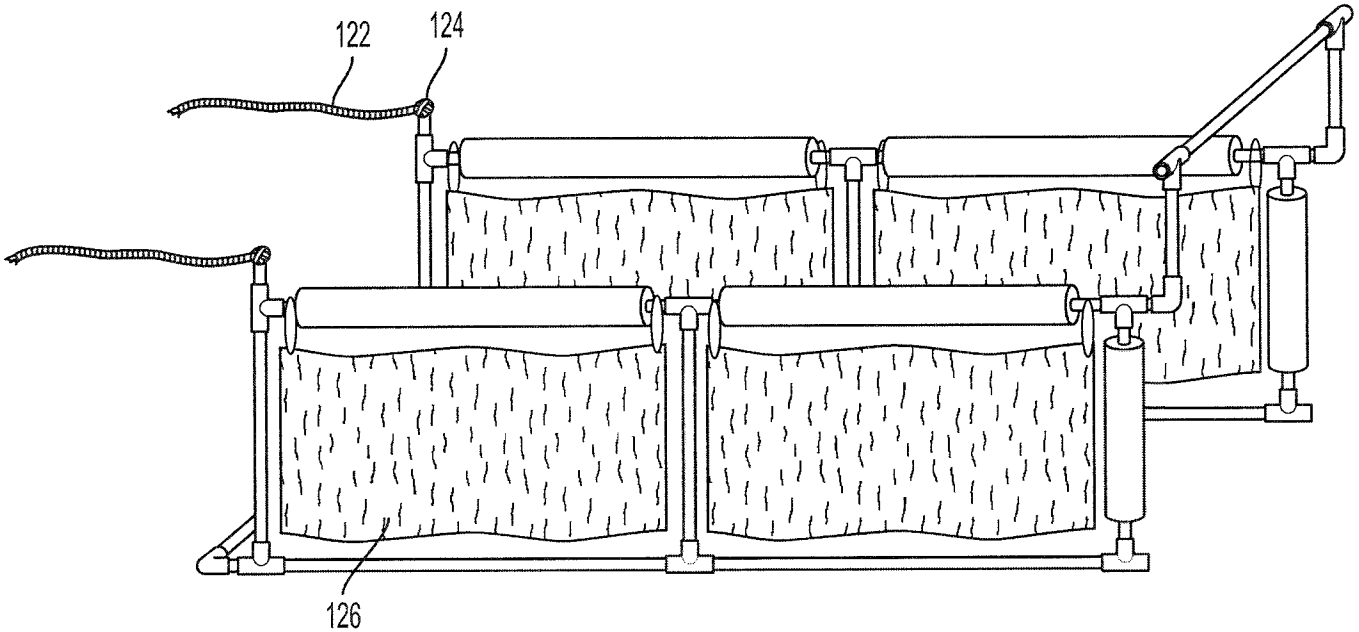
FIG. 1B shows another example of a swim lane apparatus having a different attachment or tethering device and a different barrier as a sidewall according to an aspect of the invention.

The one or more attachment or tethering devices 102 may have an anchor 104 and/or one or more interconnected pipes 106. The anchor 104 and/or the one or more interconnected pipes 106 may be made from stainless steel, a poly-vinyl carbonate (PVC) pipe or other thermoplastic polymer, as shown in FIG. 1A for example. The anchor may be positioned at a 90 degree elbow relative to the one or more interconnected pipes 106. The one or more attachment or tethering devices 102 may be anchored, hooked, bolted, inserted into a cavity or sleeve, or otherwise connected to a foundation of the pool, as shown in FIG. 3 for example. The one or more attachment or tethering devices 102 may be a rope 122, chain or other tethering device that may have a knot 124 or be otherwise knotted, fastened or coupled to the side walls 108 or an anchor or other mechanism that couples to the foundation of the pool, as shown in FIG. 1B for example. FIG. 1B shows a swim lane apparatus 100 that uses a rope 122 as a tethering device to an anchor or the foundation of the pool. The rope 122 may be tied to the anchor or have an anchor attached that is inserted into a cavity within the foundation of the pool, for example.

When the one or more attachment or tethering devices 102 are coupled to the foundation of the pool, the one or more attachment or tethering devices 102 may fix the position of the other components of the swim lane apparatus 100, such as placing or holding the one or more sidewalls 108 partially submerged within the water of the pool. Moreover, the one or more attachment or tethering devices 102 may prevent the other components of the swim lane apparatus 100 from drifting or floating when partially submerged within the water of the pool. This allows the swim lane apparatus 100 to form a swim lane 110 that does not drift while the swimmer is swimming in between the one or more sidewalls 108.

The one or more sidewalls 108 of the swim lane apparatus 100 may form a swim lane 110. The one or more sidewalls 108 may include multiple sidewalls 108*a-b*. The multiple sidewalls 108*a-b* may include a first sidewall 108*a* and a second sidewall 108*b* that are connected by one or more support members 112 in between to space the sidewalls apart. The first sidewall 108*a* and the second sidewall 108*b* may be positioned substantially parallel to each other and spaced apart to form a swim lane 110 in between. The width between the first sidewall 108*a* and the second sidewall 108*b* may be approximately at least 2.5 feet across to accommodate a swimmer within the swim lane 110. The swim lane 110 may have an entrance 116 and an exit 130. A current of water enters the swim lane 110 through the entrance 116 and exits through the exit 130.

In some implementations, the one or more sidewalls 108 may be a single sidewall, such as the first sidewall 108*a* or the second sidewall 108*b*, which is positioned substantially parallel to a sidewall of the foundation of the pool. This forms a swim lane 110 in between the sidewall of the swim lane apparatus 100 and the sidewall of the foundation of the pool. In some implementations, the swim lane apparatus 100 may have three or more sidewalls 108, which form two different swim lanes 110 so that a swimmer may swim in each swim lane 110. Each sidewall 108 may parallel to the other sidewalls 108, which forms the swim lanes 110 between two adjacent sidewalls 108.

In some implementations, one or more of the sidewalls 108 may be angled inward toward the swim lane 110. When the one or more sidewalls 108 are angled inward, the one or more sidewalls 108 focus or direct the current or flow of water out of a swim jet inward and toward the exit of the swim lane 110. This creates a current with a larger opposing force against a swimmer swimming against the current within the swim lane 110.

The one or more sidewalls 108 may be angled inward to form a funnel. The funnel directs, funnels or otherwise funnels the flow of water that enters toward an exit. The funnel creates a flow of water that opposes or resists the swimming motion of the swimmer. The swimmer may swim within the swim lane 110 or outside the exit. In some implementations, the funnel may be formed by two sidewalls that are semi-circled shaped so that when positioned about a swim jet 202 the two sidewalls form a circle. The funnel or circle-shaped sidewalls redirect the water ejected out of the swim jet 202 toward the exit of the swim apparatus 100 to create resistance for the swimmer. The swimmer may swim behind or on the outside of the exit.

The one or more sidewalls 108 may have one or more support members 112 and one or more barriers 114. The one or more support members 112, the one or more barriers 114, and/or the one or more attachment or tethering devices 102 may be composed of components that are attachable and detachable to allow the swim lane apparatus 100 to collapse for easy storage and transport. The one or more sidewalls 108 may be shortened and/or lengthened by adding and/or removing the components. Additionally, the distance between the one or more sidewalls 108 may be widened and/or narrowed by adding and/or removing components in between the one or more sidewalls 108. The shape of the swim lane apparatus 100 may be changed or modified to be shaped as a circle, funnel or other polygon by adding and/or removing components, for example.

The one or more support members 112 may interconnect to form a frame around each of the one or more barriers 114. The one or more support members 112 may be one or more interconnected pipes or one or more other tethering mechanisms, such as a rope or chain. The one or more interconnected pipes may be formed from stainless steel, PVC or other thermoplastic material. The use of interconnected pipes allows for easy assembly or disassembly to allow for portability and/or modularity. The one or more other tethering mechanisms may be a rope or chain. The rope or chain may run the length of the swim lane apparatus 100 and hold the one or more barriers 114, such as a fabric or plastic that runs along the rope or chain.

In some implementations, the one or more support members 112 may have an internal cavity. The one or more support members 112 of an upper portion of the one or more sidewalls 108 may be closed off so that no water enters the internal cavity. This allows the one or more support members 112 of the upper portion to float or remain buoyant to keep the upper portion of the one or more sidewalls 108 buoyant. The one or more support members 112 of a lower portion of the one or more sidewalls 108 may be open to allow water to enter the internal cavity. This keeps the lower portion submerged under the water of the pool. The one or more support members 112 may connect or couple to the one or more barriers 114.

The one or more barriers 114 may be a rigid material, such as stainless steel, a plastic, plexi-glass, or other solid material, or may be made from a flexible and/or a semi-permeable membrane 126 or material, such as a tarp or fabric. A flexible material allows the one or more barriers 114 to further collapse for easy storage.

The one or more barriers 114 may be connected, fastened or otherwise loosely or rigidly coupled to the one or more support members 112. For example, the one or more interconnected pipes may have a crevice, groove or cavity 128 along the longitudinal axis of the one or more interconnected pipes that allows a barrier 114 to slide into the crevice, groove or cavity 128 to connect, couple or otherwise interconnect the barrier 114 within the one or more interconnected pipes so that the one or more interconnected pipes form a frame around the barrier 114 and hold the barrier 114 in place. In another example, the barrier 114 may have one or more holes or openings with rings on the edges of the holes or openings where the rope, chain or other tethering mechanism may be inserted to hold the barrier 114 in place.

The swim lane apparatus 100 may have one or more flotation devices 118. The one or more flotation devices 118 may be connected to various positions on the one or more support members 112 of the one or more sidewalls 108. The one or more flotation devices 118 may be coupled, wrapped, surround, or otherwise enclosed around one or more support members 112. In some implementations, the one or more flotation devices 118 may be tethered to the one or more support members 112.

For example, a flotation device 118*a* of the one or more flotation devices 118 may be connected, positioned or coupled to an upper support member 112*a* of the one or more support members 112. The flotation device 118*a* assists the upper portion of the sidewall 108*a* to remain buoyant and above the surface of the water within the pool when the bottom portion of the swim lane apparatus 100 is partially submerged under the water. In another example, the flotation device 118*b* of the one or more flotation devices 118 may be connected, positioned or coupled to a side support member 112*b* of the one or more support members 112. The flotation device 118*b* may assist in keeping the upper portion of the sidewall 108*a* buoyant.

The one or more flotation devices 118 may be made from polystyrene foam or other buoyant material. In some implementations, the one or more flotation devices 118 may have a cavity filled with a gas or air that assists in maintaining the buoyancy of the one or more flotation devices 118.

The swim lane apparatus 100 may have a raised portion 120. The raised portion 120 may be positioned near or approximately at the exit of the swim lane 110 and may connect two sidewalls 108*a-b* together. The raised portion 120 may be formed using one or more support members 112. The raised portion 120 connects the two sidewalls 108*a* and 108*b* together while allowing the swimmer to easily enter, exit and swim within the swim lane 110. For example, the raised portion is positioned at a height above the one or more sidewalls 108, which allows the swimmer to raise their arm or kick their feet in a swimming motion without making contact. Thus, the swimmer can perform a kicking or swimming motion unimpeded within the swim lane 110.

Figure 2:
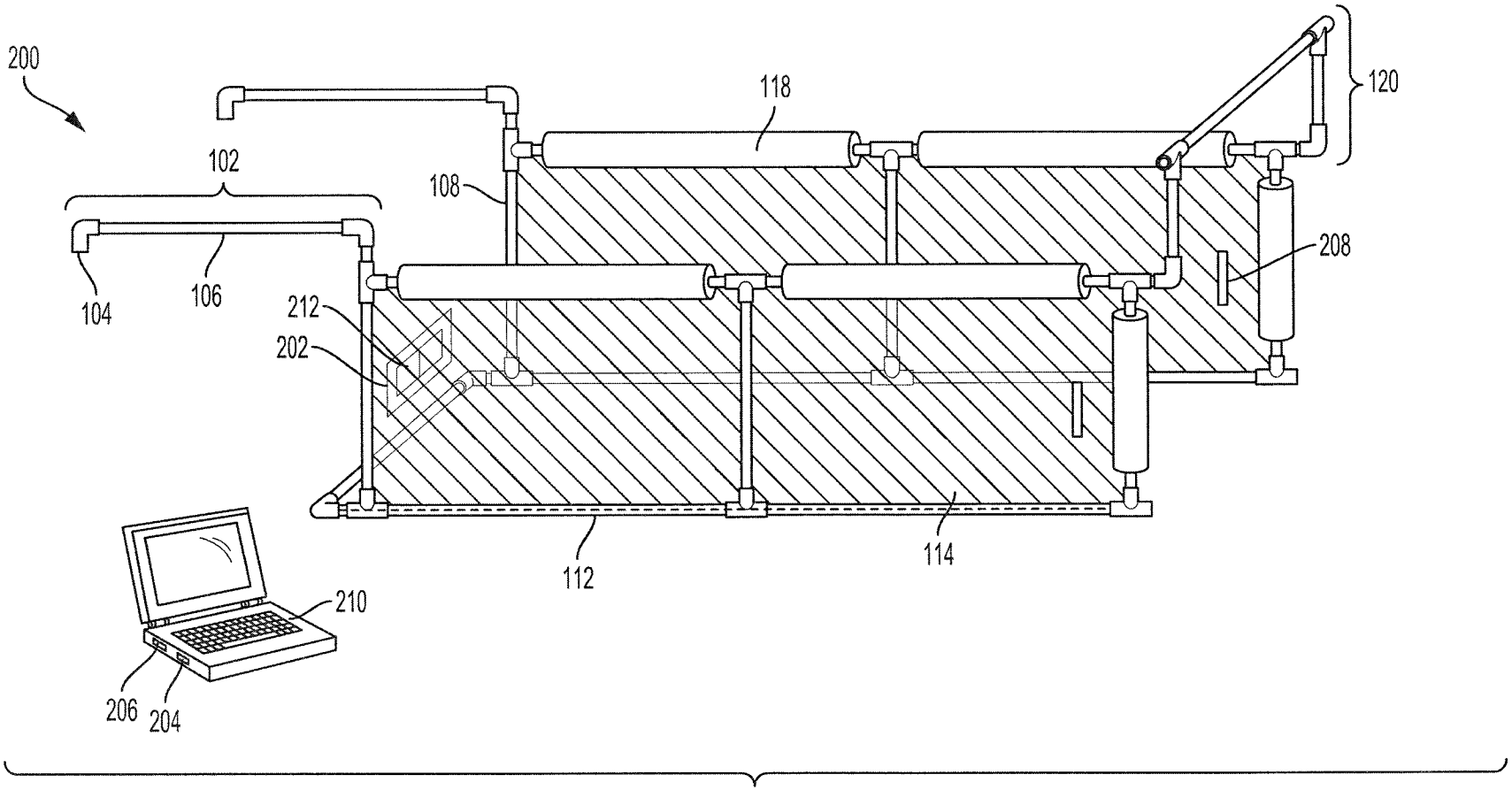
FIG. 2 shows an example swim lane system that includes a swim lane apparatus according to an aspect of the invention.

FIG. 2 shows a swim lane system 200 that includes the swim lane apparatus 100. The swim lane system 200 may include a swim jet 202, a processor 204, a memory 206, one or more sensors 208 and/or a user interface 210. The swim lane system 200 may control components of the swim lane apparatus 100 and/or the speed of the blower of the swim jet 202 to adjust a speed or flow of the current of water within the swim lane 110. For example, the swim lane system 200 may adjust the width of the swim lane 110 to accommodate a swimmer. In another example, the swim lane system 200 may adjust an angle of the one or more sidewalls 108 and/or the speed of the blower of the swim jet 202 to increase or decrease the amount or speed of the flow of the current of water within the swim lane 110.

The swim lane system 200 includes a swim lane apparatus 100 and a swim jet 202. The swim lane apparatus 100 may be positioned such that the one or more sidewalls 108 are positioned with the swim jet 202 in between the two or more sidewalls 108 or a sidewall 108*a* or 108*b* with a sidewall of the foundation of the pool. The swim jet 202 may be centered in between the two or more sidewalls 108 such that current is centered along a longitudinal axis 506 in the center of the swim lane 110 formed between two or more sidewalls 108 or a sidewall 108*a* or 108*b* with a sidewall of the foundation of the pool.

The swim lane system 200 includes one or more swim jets 202. The one or more swim jets 202 eject, blow, pump or move water out of one or more nozzles 212 to create a current or flow of water directed along a longitudinal axis. The one or more swim jets 202 may be connected or positioned within the foundation of the pool to create the current or the flow of water. The one or more swim jets 202 create the current or the flow of water to allow a swimmer to swim against the current or the flow of water so that the swimmer may continuously swim relatively in-place or within a confined area.

The swim lane system 200 may include a processor 204 that is electrically coupled to the swim jet 202 and/or the swim lane apparatus 100. The processor 204 may include multiple processors. The processor 204 may receive data from one or more components, such as the one or more sensors 208, and control operation of the one or more components based on received or determined data.

For example, the processor 204 may receive data, from the one or more sensors 208, which indicates that the current of the water within the swim lane 110 is not strong enough, and cause the swim jet 202 to increase a flow rate of the outputted water or angle the one or more sidewalls 108 more inward to increase the flow rate of the water within the swim lane 110. The current of water within the swim lane 110 may not be strong enough if the one or more sensors 208 detect that the rate of flow of the current of water is less than a threshold amount or that the swimmer is swimming at a faster rate than the current, for example. In another example, the processor may receive data, from the one or more sensors, which indicates that the current of the water within the swim lane 110 is too strong, and cause the swim jet 202 to decrease the flow rate and/or angle the one or more sidewalls 108 more outward to decrease the flow rate of the water within the swim lane 110.

The memory 206 may be coupled to the processor 204. The memory 206 may store instructions to execute on the processor 204 and may include one or more of a random access memory (RAM) or other volatile or non-volatile memory. The memory 206 may be a non-transitory memory or a data storage device, such as a hard disk drive, a solid-state disk drive, a hybrid disk drive, or other appropriate data storage, and may further store machine-readable instructions, which may be loaded and executed by the processor 204.

The processor 204 may be coupled to one or more sensors 208 that detect external environmental parameters. The one or more sensors 208 may detect or measure a rate or speed of the current of the water within the swim lane 110. The one or more sensors 208 may detect a position of the swimmer within the swim lane 110 and/or a rate or speed of the swimmer swimming within the swim lane 110.

The swim lane apparatus 100 may include a user interface 210. The user interface 210 may be a personal device, e.g., a mobile phone, a tablet, a personal computer. The user interface 210 may include any device capable of receiving user input, such as a button, a dial, a microphone, or a touch screen, and any device capable of output, e.g., a display, a speaker, or a refreshable braille display. The user interface 210 allows a user to monitor, control or adjust the one or more components of the swim lane system 200.

Figure 4:
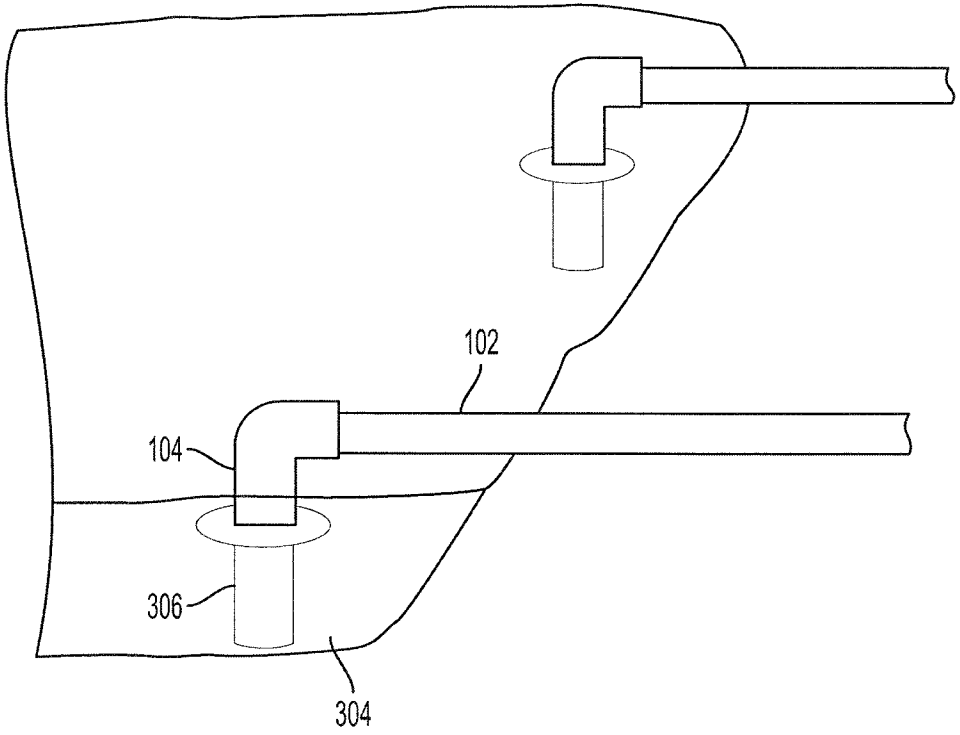
FIG. 4 shows a close-up view of the one or more attachment or tethering devices coupled to the foundation of the pool according to an aspect of the invention.

FIG. 3 shows the swim lane apparatus 100 anchored or tethered to the foundation 304 of the pool 300. The foundation 304 may be a concrete or other rigid structure. The foundation 304 may have a cavity or hole 306, which receives the anchor 104 of the one or more attachment or tethering devices 102 of the swim lane apparatus 100. In some implementations, the foundation 304 may have a pole or other device that protrudes from the foundation or attached to the foundation, which the one or more attachment or tethering devices 102, such as a rope 122, may tie, tether or otherwise fasten. FIG. 4 shows a close-up perspective view of the anchor 104 within the cavity or hole 306 of the foundation 304. When the anchor 104 is inserted into the cavity or hole 306, the swim lane apparatus 100 may be in a fixed position that holds the swim lane apparatus 100 in place in the pool 300.

When the swim lane apparatus 100 is placed in the pool 300, an upper portion 308 of the one or more sidewalls 108 may be above the water 302 of the pool 300 and a lower portion 310 may be partially submerged under the water 302 of the pool 300. The one or more flotation devices 118 keep the upper portion 308 above the water 302 when the swim lane apparatus 100 is placed in the pool 300, e.g., at a height 2 inches above the water. By having an upper portion 308 above the surface of the water 302 and a lower portion 310 below the surface of the water 302, the swim lane apparatus 100 forms the swim lane 110, which directs the current of the water from the entrance 116 of the swim lane 110 to the exit 118 of the swim lane 110.

Figure 5A:
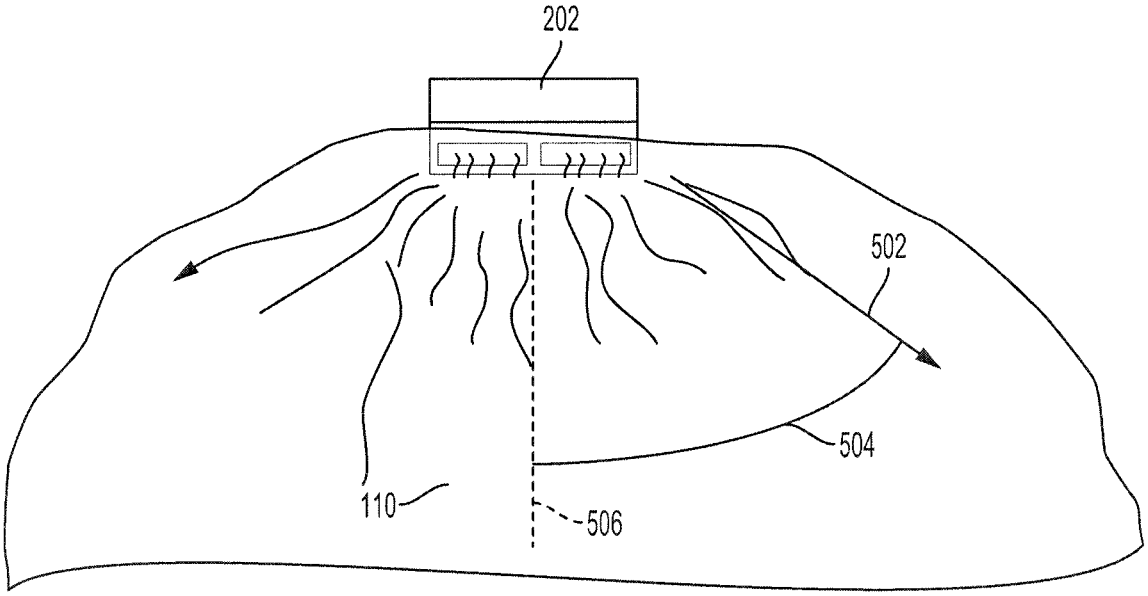
FIG. 5A shows the current of the water ejected from the one or more swim jets without a swim lane apparatus according to an aspect of the invention.
Figure 5B:
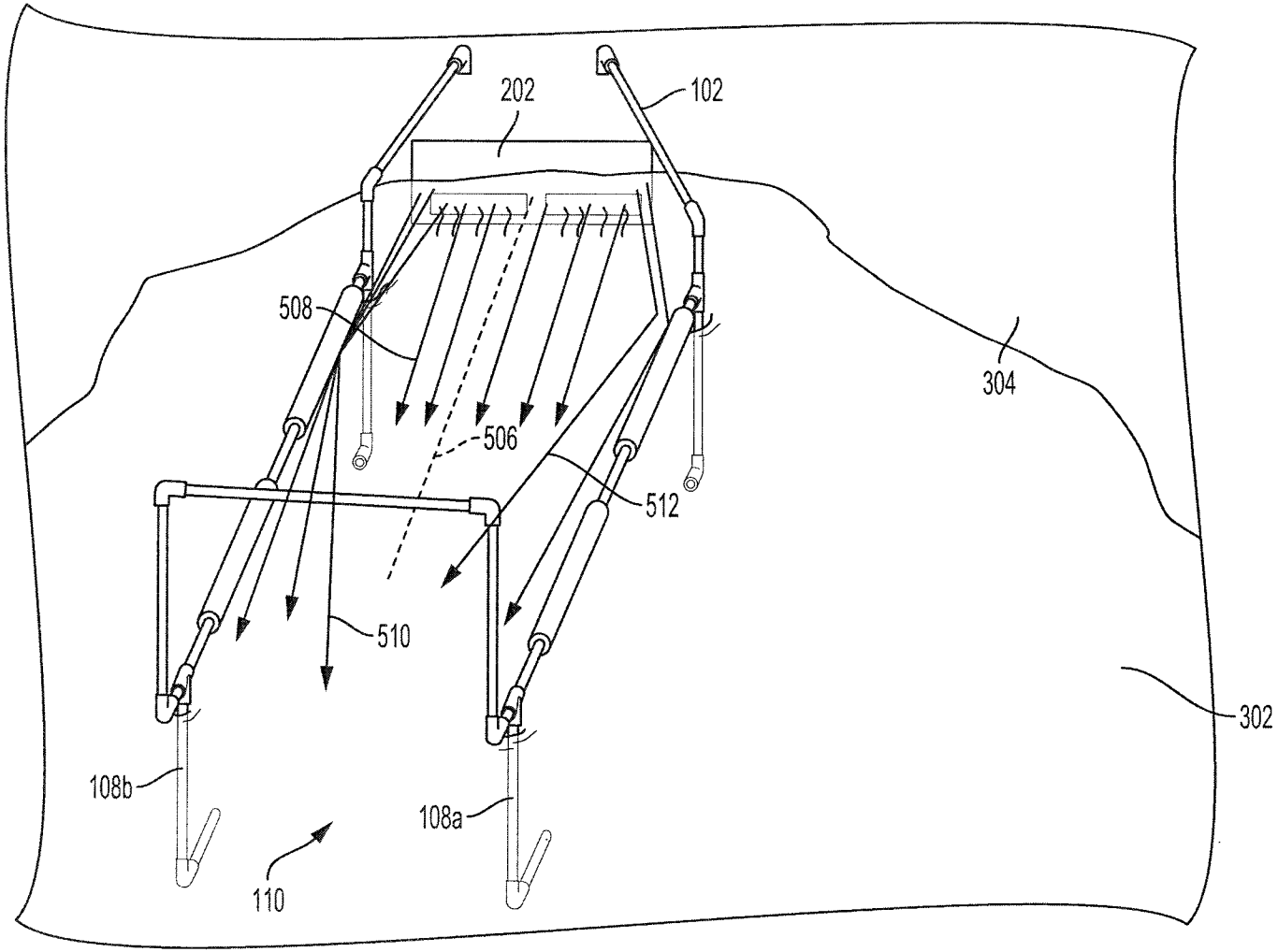
FIG. 5B shows the current of the water ejected from the one or more swim jets with a dual-walled swim lane apparatus according to an aspect of the invention.
Figure 5C:
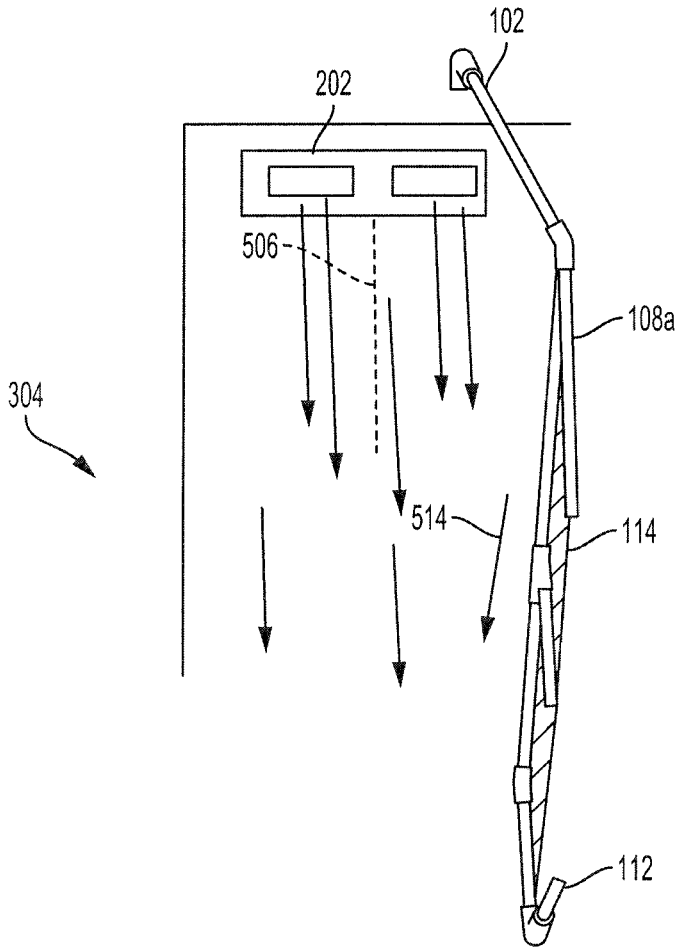
FIG. 5C shows the current of the water ejected from the one or more swim jets with a single-walled swim lane apparatus according to an aspect of the invention.

FIGS. 5A-5C show the direction of the current of the water out of the swim jet 202 with and without the swim lane apparatus 100. FIG. 5A shows the swim jet 202 ejecting, blowing, pushing or otherwise moving the current of the water out the swim jet 202. As the swim jet 202 ejects or moves the water out of the swim jet 202, the current of water is directed along the longitudinal axis 506, which represents a position of a swim lane 110 where the current of the water is not dispersed and is directly in the path of and opposes the swimming motion of the swimmer. As the current of water exits further from the swim jet, the current of the water may disperse and move farther away from the swim jet 202 along the direction 502. The swim jet 202 may disperse a portion of the current of water in the direction 502 at an angle 504 relative to the longitudinal axis 506 of the swim lane 110. As the current of water disperses, a portion of the power or force of the current also disperses in the direction 502, and thus, the portion power or force of the current directed along the longitudinal axis 506 decreases. Thus, without a swim lane apparatus 100 more power is necessary to pump more water out of the swim jet 202 in order to achieve an equivalent amount of power or force of the current to oppose the swimmer within the swim lane 110 of the swim lane apparatus 100.

FIG. 5B shows the swim lane apparatus 100 placed in the water to direct or funnel the flow of the current of the water after the swim jet 202 ejects, blows or moves the water into the swim lane 110. The first sidewall 108*a* and the second sidewall 108*b* form the swim lane 110. The first sidewall 108*a* and the second sidewall 108*b* redirect, funnel, or focus any portion of the current of the water that angles outward back inward toward the longitudinal axis 508 to maximize the force of the current against the swimming motion of the swimmer and in the direction along the longitudinal axis 506. For example, the first sidewall 108*a* redirects a portion of the current of water inwards in the direction 512 when the current of water impacts the first sidewall 108*a*. In another example, the second sidewall 108*b* redirects a portion of the current of water inwards in the direction 510 when the current of water impacts the second sidewall 108*b*.

FIG. 5C shows the swim lane apparatus 100 with only a single sidewall 108*a* or 108*b*. The single sidewall 108*a* or 108*b* may be used in conjunction with a sidewall of the foundation 304. The single sidewall 108*a* or 108*b* may be either the left or right sidewall that forms the swim lane 110 in conjunction with the sidewall of the foundation 304. The single sidewall 108*a* or 108*b* may redirect an angled current or flow of water back inward toward the longitudinal axis 506 such that the swim lane apparatus 100 maximizes the current or flow of water that opposes the swim motion of the swimmer within the swim lane 110.

Figure 6:
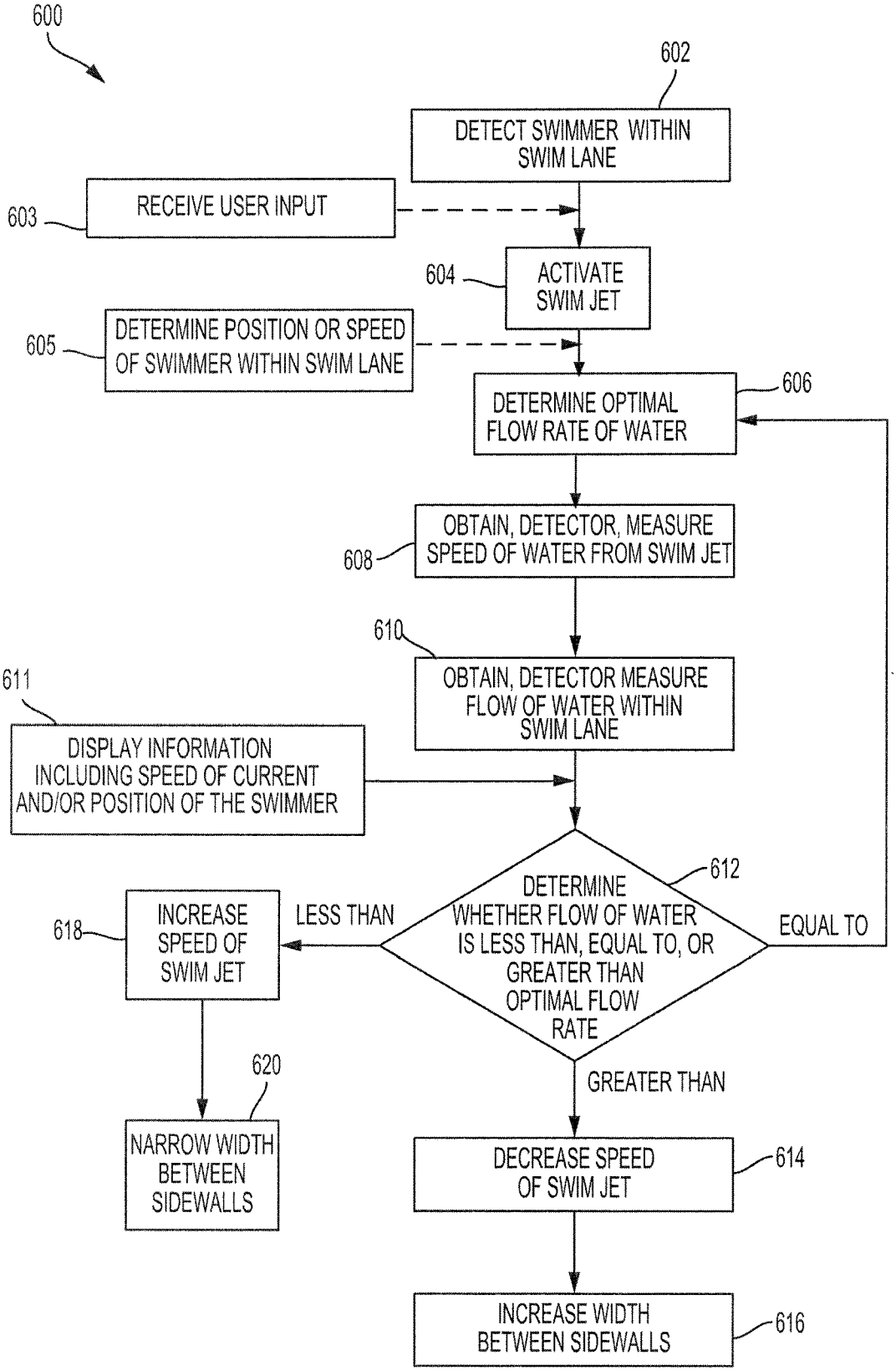
FIG. 6 is an example process for controlling the current or flow rate of the water within a swim lane according to an aspect of the invention.

FIG. 6 is a flow diagram of a process 600 for controlling or adjusting the force of the current within the swim lane 110. One or more computers or one or more data processing apparatuses, for example, the processor 204 of the swim lane system 200 of FIG. 2, appropriately programmed, may implement the process 600.

The swim lane system 200 may use one or more sensors 208 to detect a swimmer within the swim lane 110 (602). The one or more sensors 208 may include a motion sensor or an infrared sensor. The motion sensor may detect a swimming motion of the swimmer to determine that there is a swimmer within the swim lane 110 and/or a position of the swimmer, for example. In another example, the infrared sensor may detect the heat of the body of the swimmer within the swim lane 110 to determine that there is a swimmer within the swim lane 110 and/or a position of the swimmer.

The swim lane system 200 may receive user input that indicates the rate, position and/or speed of the swimmer within the swim lane 110 (603). The swim lane system may receive user input via the user interface 210, such as from a laptop, or via a knob on the swim lane apparatus 100 or the swim jet 202. The user input may include the speed and/or position of the swimmer within the swim lane 110 and/or may indicate an optimal rate of the current or flow of the water out the swim jet 202 or within the swim lane 110. In some implementations, the user input is an identity of the swimmer. The identity may be associated with user preferences for the optimal rate of the current or flow of the water.

The swim lane system 200 may activate one or more swim jets 202 (604). The swim lane system 200 may turn on the one or more swim jets 202 to pump, move or otherwise eject out a current of water within the swim lane 110. The swim lane system 200 may adjust the speed of a pump to eject or move the current of water out the one or more swim jets 202.

The swim lane system 200 may detect, measure or otherwise determine the position or speed of the swimmer within the swim lane 110 (605). The swim lane system 200 may use a position sensor to detect a position of the swimmer within the swim lane 110 and/or a speed sensor to detect or measure a rate of speed of the swimmer within the swim lane 110.

The swim lane system 200 may determine an optimal flow rate of water for the current within the swim lane 110 (606). The optimal flow rate may be based on the user input, pre-configured, an identity of the swimmer and/or a position or speed of the swimmer. The swim lane system 200 may receive user input that is associated with the optimal flow rate of the water, and may determine the optimal flow rate of water based on the user input. In some implementations, the swim lane system 200 may match an identity of the swimmer to a preferred optimal flow rate in a database stored within the memory 206 to determine the optimal flow rate of water. In some implementations, the optimal flow rate may be pre-configured.

The swim lane system 200 may use other factors, such as the position of the swimmer and/or rate of speed of the swimmer to determine the optimal flow rate. For example, if the swimmer is toward the entrance of the swim lane 110, the optimal flow rate may be too slow, and thus, the swim lane system 200 may increase the optimal flow rate. Similarly, if the swimmer is toward the exit of the swim lane 110, the optimal flow rate may be too fast, and thus, the swim lane system 200 decrease the optimal flow rate. In another example, the swim lane system 200 may approximately equate the swimmer's speed to the optimal flow rate.

As the water is ejected from the one or more swim jets 202, the swim lane system 200 may use the one or more sensors 208 to detect, measure or otherwise obtain the speed of the current of the water out the one or more swim jets 202

(608). The one or more sensors 208 may be positioned at or near an entrance of the swim lane 110 created by the swim lane apparatus 100 in proximity to the one or more swim jets 202 to measure the speed of the current of the water before the water dissipates at a wider angle. This allows the swim lane system 200 to calculate the flow of the current at the front portion of the swim lane 110.

Moreover, the swim lane system 200 may use the one or more sensors 208 to detect, measure or otherwise obtain the flow of the current of the water within the swim lane 110 (610). The one or more sensors 208 may be positioned at or near the exit of the swim lane 110. The flow of the current of the water within the swim lane 110 accounts for any portions of the current of the water that is redirected and/or focused inward by the one or more sidewalls 108 of the swim lane apparatus 100. By having the speed of the current of the water at the entrance and/or at the exit, the swim lane system 200 may better approximate the opposing force of the current against the swimmer within the swim lane 110 when the swimmer is swimming within the swim lane 110.

The swim lane system 200 may display the rate of speed of the current flow of the water on the user interface 210 (611). The swim lane system 200 may display other information, such as the rate the swimmer is swimming and/or the position of the swimmer on the user interface 210.

The swim lane system 200 may determine whether the flow of the water is less than, equal to or greater than the optimal flow rate (612). The swim lane system 200 compares the optimal flow rate to the measured flow of the current of the water within the swim lane and/or the measured speed of the current of the water out the one or more swim jets 202. If the measured flows and/or speeds of the current are approximately the same as or within a threshold error rate or within a range of the optimal flow rate, the swim lane system 200 continues to monitor the current within the swim lane 110 and determine the optimal flow rate (606).

If the measured flows and/or speeds are greater than the range that encompasses the optimal flow rate, the swim lane system 200 decreases the speed of the swim jet 202 (614) and/or increase the width of the swim lane 110 (616). The swim lane system 200 may decrease the speed of the pump of the swim jet 202 so that the one or more swim jets 202 push, move or otherwise eject less water out, which decreases the flow rate of the current within the swim lane 110. The swim lane system 200 may increase the width between a sidewall of the swim lane apparatus 100 and another sidewall of the swim lane apparatus 100 and/or the sidewall of the swim lane apparatus 100 and a sidewall of the foundation of the pool to decrease the flow rate of the current within the swim lane 110. By increasing the width, the swim lane apparatus 100 disperses the current or flow of water within the swim lane 110, which results in a decrease in the flow rate of the current within the swim lane 110. In some implementations, the swim lane system 200 may angle one or both sidewalls of the swim lane apparatus 100 more outward to the longitudinal axis 506 of the swim lane 110 to decrease the flow rate of the current within the swim lane 110. The swim lane system 200 may use one or more actuators (not shown) to adjust the width, angle or direction of the one or more sidewalls 108 of the swim lane apparatus 100.

If the measured flows and/or speeds are less than the range that encompasses the optimal flow rate, the swim lane system 200 increases the speed of the swim jet 202 (618) and/or decreases the width of the swim lane 110 (620). The swim lane system 200 may increase the speed of the pump of the swim jet 202 so that the one or more swim jets 202 push, move or otherwise eject more water out, which increases the flow rate of the current within the swim lane 110. The swim lane system 200 may decrease the width between a sidewall of the swim lane apparatus 100 and another sidewall of the swim lane apparatus 100 and/or the sidewall of the swim lane apparatus 100 and a sidewall of the foundation of the pool to increase the flow rate of the current within the swim lane 110. By decreasing the width, the swim lane apparatus 100 focuses or directs the current or flow of water within the swim lane 110, which results in an increase in the flow rate of the current within the swim lane 110. In some implementations, the swim lane system 200 may angle one or both sidewalls of the swim lane apparatus 100 more inward toward the longitudinal axis 506 of the swim lane 110 to increase the flow rate of the current within the swim lane 110.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A swim lane apparatus for a pool, comprising:

one or more attachment or tethering devices that are configured to couple or affix to a foundation of the pool;

a first sidewall coupled to the one or more attachment or tethering devices;

a second sidewall coupled to the one or more attachment or tethering devices, the first sidewall and the second sidewall being configured to form a channel or a swim lane and direct a flow of water out of the channel or the swim lane when the flow of water enters the channel or the swim lane; and a connecting member that connects and spaces apart the first sidewall and the second sidewall and that is positioned at an exit of the channel or the swim lane in a raised position that allows a user to swim within the channel or the swim lane.

2. The swim lane apparatus of claim 1, wherein the second sidewall is positioned parallel to the first sidewall.

3. The swim lane apparatus of claim 1, wherein the channel or the swim lane has an entrance, wherein the flow of water enters the channel or the swim lane at the entrance, and the first sidewall and the second sidewall are configured to direct the flow of water in a longitudinal direction substantially parallel to the channel or the swim lane and toward the exit of the channel or the swim lane or in a direction angled inward.

4. The swim lane apparatus of claim 1, wherein the one or more attachment or tethering devices are coupled or affixed in proximity to a sidewall of the foundation of the pool.

5. The swim lane apparatus of claim 1, wherein the first sidewall includes:

a first barrier that is configured to direct the flow of water through the channel or the swim lane;

one or more first support members connected to the first barrier and configured to provide structural support to hold or position the first barrier; and one or more first flotation or buoyancy devices coupled to the one or more first support members and configured to maintain a portion of the first barrier above the water when the swim lane apparatus is positioned in the water of the pool.

6. The swim lane apparatus of claim 5, wherein the second side wall includes:

a second barrier that is configured to direct the flow of water through the channel or the swim lane, and one or more second support members connected to the second barrier and configured to provide structural support to hold or position the second barrier; and one or more second flotation or buoyancy devices coupled to the one or more second support members and configured to maintain a portion of the second barrier above the water when the swim lane apparatus is positioned in the water of the pool.

7. The swim lane apparatus of claim 1, wherein the first sidewall is partially submerged underwater when positioned within the water of the pool.

8. The swim lane apparatus of claim 1, wherein the first sidewall is made from a semi-permeable membrane, wherein the one or more attachment or tethering devices is a rope, wherein the rope is fastened to the semi-permeable membrane.

9. The swim lane apparatus of claim 1, wherein the one or more attachment or tethering devices include an anchor, wherein the anchor is inserted into a cavity within the foundation to fasten or connect the one or more attachment or tethering devices to the foundation.

10. A swim lane system for a pool, comprising:

a swim jet configured to pump or move water out; and a swim lane apparatus that is configured to direct a flow of water and including:

one or more attachment or tethering devices that are configured to couple or affix to a foundation of the pool;

a first sidewall coupled to the one or more attachment or tethering devices;

a second sidewall coupled to the one or more attachment or tethering devices, the first sidewall and the second sidewall being configured to form a channel or a swim lane to direct the flow of water; and a connecting member that connects and spaces apart the first sidewall and the second sidewall and that is positioned at an exit of the channel or the swim lane in a raised position that allows a user to swim within the channel or the swim lane.

11. The swim lane system of claim 10, wherein the first sidewall and the second sidewall are both removably interconnected and are each configured to form the channel or the swim lane alone using a sidewall of the foundation.

12. The swim lane system of claim 10, further comprising:

one or more sensors configured to detect an amount or rate of the flow of water within the channel or the swim lane and a speed of the swim jet.

13. The swim lane system of claim 12, further comprising:

a processor connected to the swim jet and at least one of the first sidewall or the second sidewall, wherein the processor is configured to:

obtain the speed of the swim jet, obtain the amount or rate of the flow of water within the channel or the swim lane, and adjust or control the speed of the swim jet or an angle or position of the at least one of the first sidewall or the second sidewall based on the amount or rate of the flow of water within the channel or the swim lane.

14. A swim lane apparatus, comprising:

a plurality of sidewalls including a first sidewall and a second sidewall that are configured to form a channel or a swim lane, the first sidewall and the second sidewall remaining partially submerged when placed into a pool having water; and a connecting member that connects and spaces apart the first sidewall and the second sidewall to form the channel or the swim lane, the connecting member being positioned at an exit of the channel or the swim lane in a raised position that allows a user to swim within the channel or the swim lane.

15. The swim lane apparatus of claim 14, wherein the channel or the swim lane has an entrance, wherein the first sidewall and the second sidewall direct a flow of water that enters the entrance of the channel or the swim lane to the exit of the channel or the swim lane.

16. The swim lane apparatus of claim 15, wherein when the first sidewall and the second sidewall direct the flow of water to the exit of the channel or the swim lane, the first sidewall and the second sidewall direct the flow of water at an angle inward in between the first sidewall and the second sidewall to focus the flow of water toward the exit of the channel or the swim lane.

17. The swim lane apparatus of claim 14, further comprising:

one or more attachment or tethering devices that are configured to couple or affix to a foundation of the pool.

18. The swim lane apparatus of claim 14, further comprising:

one or more second flotation or buoyancy devices configured to maintain a portion of the plurality of sidewalls above the water in the pool when the plurality of sidewalls are partially submerged.

* * * * *